US005314112A

United States Patent [19]

Jones

[11] Patent Number: 5,314,112

[45] Date of Patent: May 24, 1994

[54] FOLDER/PORTFOLIO AND ORIGAMI CONSTRUCTION FOR FORMING IT FROM A RECTANGULAR BLANK

[76] Inventor: Eric M. Jones, 134 Pelton Ave., Staten Island, N.Y. 10310

[21] Appl. No.: 874,390

[22] Filed: Apr. 27, 1992

[51] Int. Cl.[5] ..... B65D 5/24

[52] U.S. Cl. ..... 229/117.01; 229/87.01; 229/186

[58] Field of Search ..... 229/117.07, 117.08, 229/186, 87.01

[56] References Cited

U.S. PATENT DOCUMENTS

| | | | |
|---|---|---|---|
| 728,749 | 5/1903 | McCord | 229/117.07 |
| 847,314 | 3/1907 | Burns | 229/186 |
| 1,140,741 | 5/1915 | Grunow, Jr. | 229/186 |
| 1,175,160 | 3/1916 | McDonald | 229/186 |
| 1,419,315 | 6/1922 | Sheline | 229/186 |
| 1,922,399 | 8/1933 | Schilling | 229/186 |
| 2,085,083 | 6/1937 | Perreton | 229/186 |
| 2,171,051 | 8/1939 | Stonecypher | 229/117.07 |
| 2,512,382 | 6/1950 | Ringler | 229/186 |
| 2,823,847 | 2/1958 | Barnes et al. | 229/117.07 |
| 3,289,914 | 12/1966 | Lange-Wiehe | 229/186 |
| 3,386,644 | 6/1968 | Zackheim | 229/117.07 |
| 3,511,429 | 5/1970 | Brian | 229/186 |
| 3,743,171 | 7/1973 | Nederveld | 229/186 |
| 3,964,668 | 6/1976 | Lin | 229/186 |
| 4,260,098 | 4/1981 | Manizza et al. | 229/186 |
| 4,515,270 | 5/1985 | Alvarado | 229/117.07 |

*Primary Examiner*—Stephen P. Garbe

*Attorney, Agent, or Firm*—Irving M. Weiner; Joseph P. Carrier; Pamela S. Burt

[57] ABSTRACT

A folder for storing flat sheet articles, formed from a one-piece sheet material blank to provide a rectangular container which is fabricated by appropriately folding a rectangular blank and does not require any fasteners, The device is structured in a manner that it may be collapsed about the articles to be stored in a way that completely captivates the articles.

20 Claims, 4 Drawing Sheets

FIG.11B
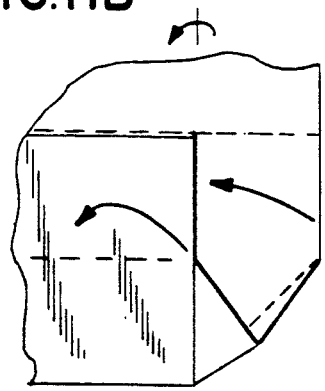
FIG.13A
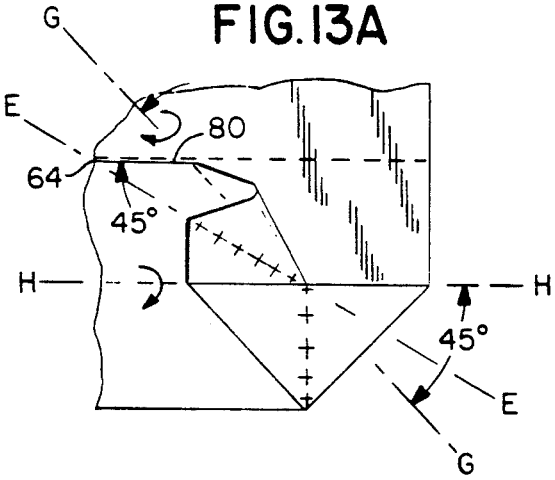
FIG.11C
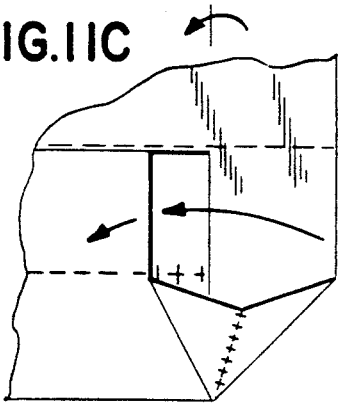
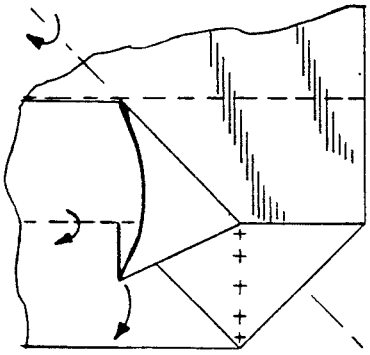
FIG.13B
FIG.12
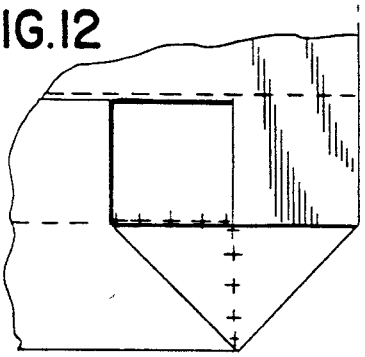
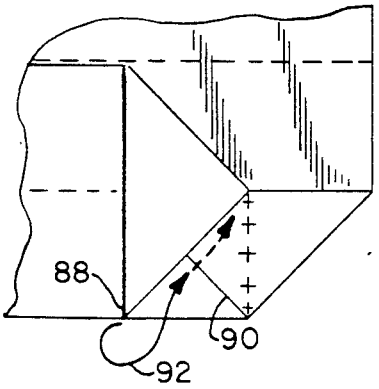
FIG.14
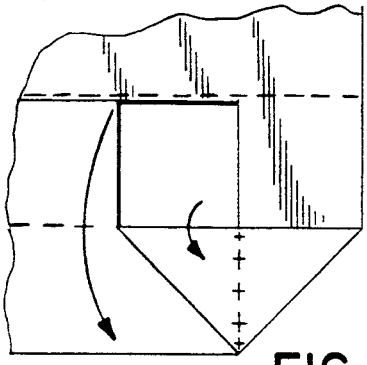
FIG.13
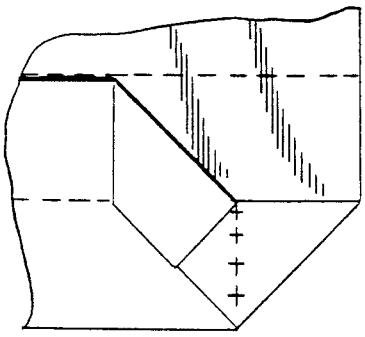
FIG.15

FIG. 16
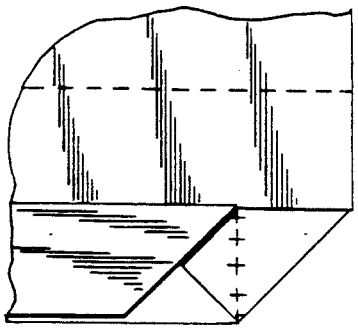
FIG. 17
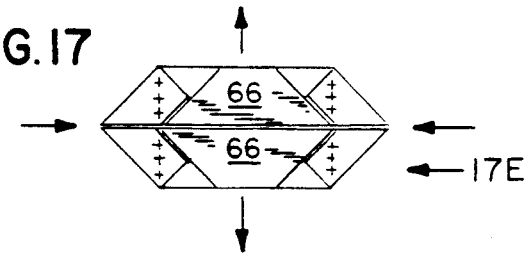
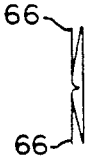
FIG. 17E
FIG. 18
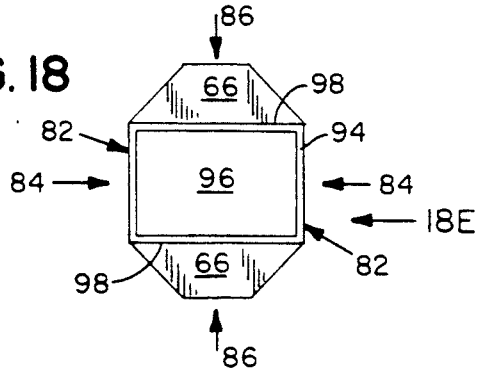
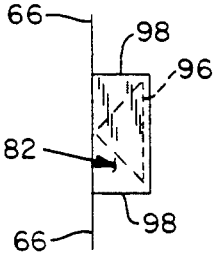
FIG. 18E
FIG. 19
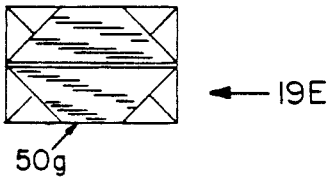
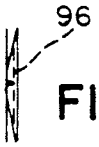
FIG. 19E, 20E
FIG. 20
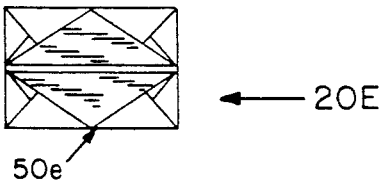

FOLDER/PORTFOLIO AND ORIGAMI CONSTRUCTION FOR FORMING IT FROM A RECTANGULAR BLANK

BACKGROUND OF THE INVENTION

The instant invention is the subject matter of Disclosure Document No.: 274274, filed in the PTO on Feb. 19, 1991, and it is respectfully requested that this document be retained beyond the two-year period so that it may be relied upon as evidence of conception of the invention during the prosecution phase of this application, should the need arise.

The instant invention relates generally to a paper folder/portfolio for storing documents therein and the method and origami construction techniques for folding paper to fabricate such a folder.

Numerous folders, cartons and containers have been provided in the prior art that are adapted to store various articles. For example, U.S. Pat. Nos. 4,895,296 to Trauschke; 3,871,572 to Staggs and 3,834,610 to Eifrid, all are illustrative of such prior art. While these units may be suitable for the particular purpose to which they address, they would not be as suitable for the purpose of the present invention as hereafter described.

SUMMARY OF THE INVENTION

A primary object of the present invention is to provide a folder/portfolio that will overcome the shortcomings of the prior art devices.

Another object is to provide a folder/portfolio that is constructed by folding a single rectangular sheet of material, typically but not limited to paper, plastic, parchment, or fiber board.

An additional object is to provide folder/portfolio that does not require the use of a separate securement fasteners or adhesives to complete the fabrication of the folder.

A further object is to provide a folder/portfolio that is structured in such a manner that it may be collapsed about the articles in a way that completely captivates the articles which are stored therein.

Yet a further object is to provide a folder/portfolio that is simple and easy to use.

A still further object is to provide a folder/portfolio that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

FIGS. 11, 11A, 11B, 11C, 12, 13, 13A, 13B, 14, 15, and 16, in an enlarged scale, all illustrate the additional later sequential steps in their respective order required to fold one corner of the blank paper pattern to create the instant invention;

FIG. 17, in a reduced scale, illustrates the paper pattern after the other three corners have also been folded in a likewise manner;

FIG. 17E is a diagrammatic end edge view taken in the direction of arrow 17E in FIG. 17; FIG. 18 is a diagrammatic plan view illustrating the instant invention in an open position and ready to receive documents to be stored therein;

FIG. 18E is a diagrammatic end edge view taken in the direction of arrow 18E in FIG. 18;

FIG. 19 illustrates the third embodiment of the instant invention in a reduced scale, which is the final result of having completed all of the appropriate foregoing described folding steps;

FIG. 20 illustrates the first embodiment of the instant invention in a reduced scale, which is the final result of having completed all of the appropriate foregoing described folding steps; and FIGS. 19E and 20E are diagrammatic edge views taken in the direction of arrows 19E and 20E in FIGS. 19 and 20 respectively.

BRIEF DESCRIPTION OF THE PREFERRED EMBODIMENTS

Figure 1:
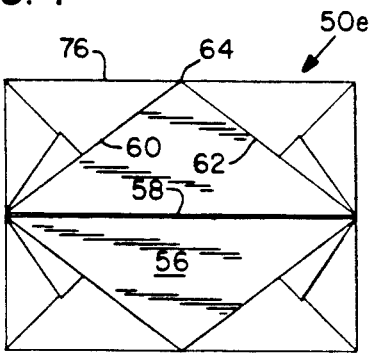
FIG. 1 is a top plan view of a first embodiment of the instant invention in a collapsed condition.
Figure 2:
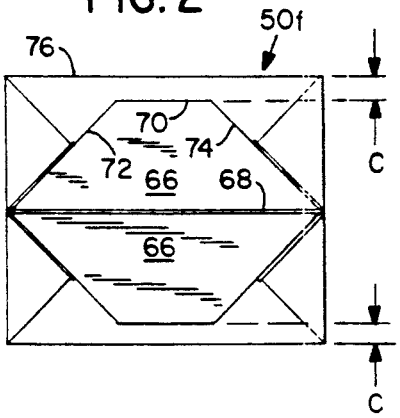
FIG. 2 is a plan view of a second embodiment of the instant invention also in a collapsed condition.
Figure 3:
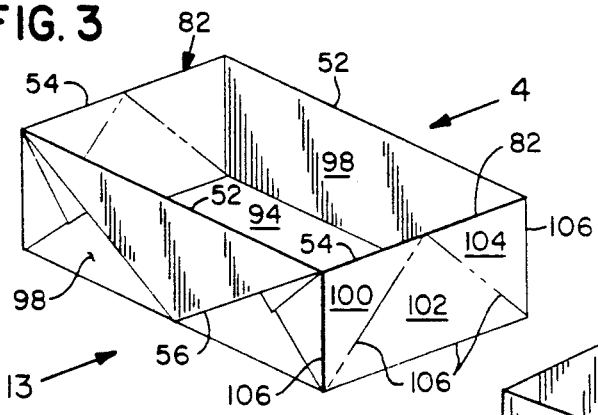
FIG. 3 is a diagrammatic perspective view of the instant invention with the sides open, ready to receive typically documents to be stored therein.
Figure 4:
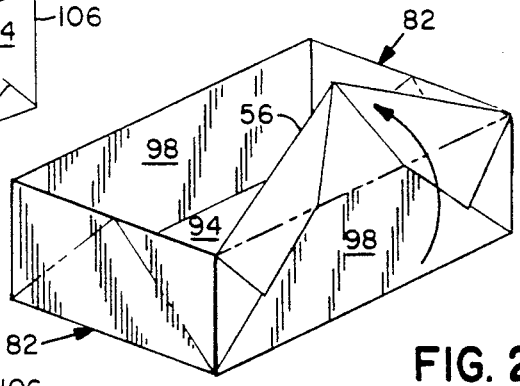
FIG. 4 is a diagrammatic perspective view taken generally in the direction of arrow 4 in FIG. 3 showing one flap bent upwardly.
Figure 6:
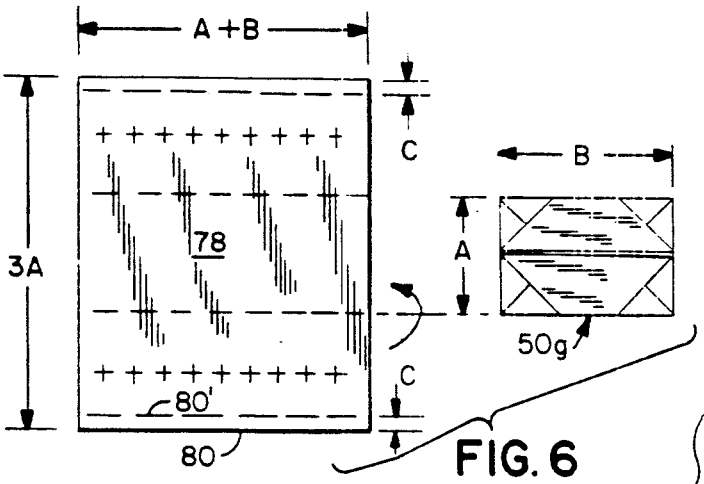
FIG. 6, is diagrammatic view in a in reduced scale, showing the relationship between the finished sized folder (right) and the blank paper pattern (left) required to construct such.
Figure 10:
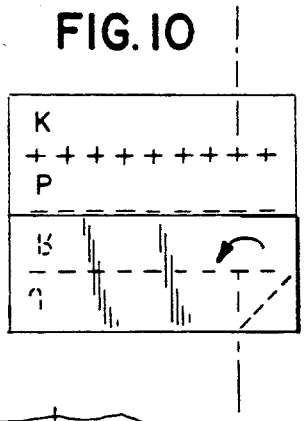
FIGS. 7, 8, 9 & 10, are views in a reduced scale, illustrating the early sequential steps in their respective order first required as a precondition so that the corners of the paper blank can then be folded to create an embodiment of the instant invention.
Figure 7:
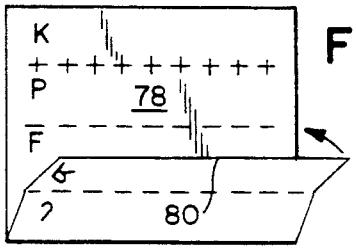
Figure 11:
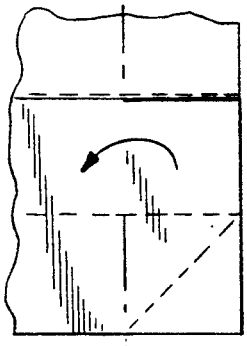
Figure 8:
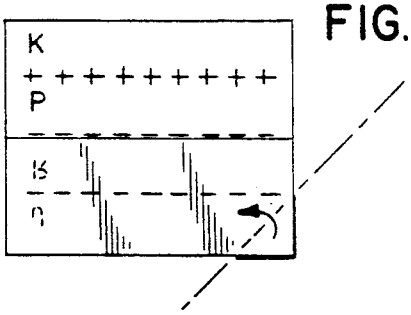
Figure 11A:
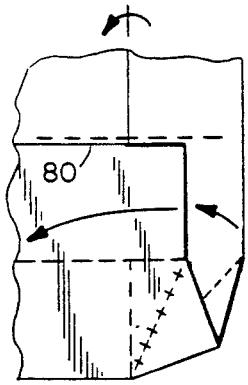
Figure 9:
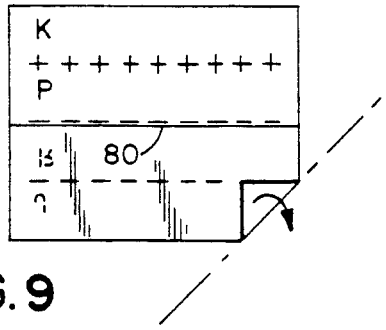

Turning now descriptively to the drawings, in which like reference characters denote like elements throughout the several views, FIGS. 1 and 2 illustrate two typical embodiments, that is a first embodiment and a second embodiment of folder/portfolios **50*e* and 50*f* respectively, while in FIG. 6 is illustrated yet a third embodiment 50*g*, all in collapsed state. FIG. 3 shows the first embodiment 50*e* with the sides 52, and 54 in an erect position so that the folder/portfolio is ready to receive documents to be stored therein. FIG. 4 illustrates the first embodiment with one handle flap 56 bent or pivoted in an upward position away from the side wall 98** so that it might be easily grasped by the user.

It is to be noted that all of the embodiments are quite similar in construction and the feature which distinguishes one embodiment from another is the shape of the handle flaps listed as follows:

The first embodiment 50e as seen in FIG. 1, has isosceles triangular handle flaps 56 with three edges 58, 60 and 62, with the later two equal length edges meeting at an apex 64;

The second embodiment 50f as seen in FIG. 2, has isosceles trapezoidal shaped handle flaps 66 having a long edge 68 and a short edge 70 parallel to each other and two isosceles equal edges 72 and 74; and The third embodiment 50g as seen in FIG. 6 is almost identical to the second embodiment but is a special case in which the short edge 70 lies directly over edge 76 of the folder/portfolio 50f so that dimension C is equal to zero.

In order to construct the first or third embodiment of the rectangular folder/portfolio which typically has general dimensions of $A \times B$ when folded, where A is always shorter than B, or at best in the limiting case where A is equal to B and then the folder/portfolio turns out to be exactly square, a paper blank must be chosen having the dimensions $(3A) \times (A+B)$. To construct the second embodiment of the rectangular folder/portfolio which typically has general dimensions of $A \times B$ when folder, where A is always shorter than B, but where the short flap edge 70 is separated from the edge 76 of the folder/portfolio 50f by the dimension C, a paper blank must be chosen having the dimensions $(3A-2C) \times (A+B)$. These facts are best illustrated by examining FIG. 6 with respect to FIGS. 1 and 2.

FIGS. 7 through 10 illustrate a paper blank 78 chosen in accordance with the formula indicated above being accordingly sequentially first folded so as to prepare the blank, so that the four corners of the blank may be each separately subsequently folded as indicated by the sequence of FIGS. 11 through 16. The folding steps required to create either the first or third embodiment are identical until FIG. 13A. If the corner portion of the paper is folded along line E—E then the first or third embodiment 50f or 50g respectively of the folder/portfolio is that which results as the end product of such a choice. If the corner portion of the paper is folded along line G—G then the second embodiment 50e of the folder/portfolio is that which results as the end product of this choice.

It should be observed that fold line E—E is chosen to intersect the edge 80 of the blank 78 at 45°, while fold line G—G is instead chosen to intersect the edge 80 at the midpoint 64 thereof. When the rest of the steps from FIG. 13B through 16 have been executed all the required folds to fabricate a single corner are completed, and the result is best seen in FIG. 16, which actually illustrates the third embodiment 50g. Repeating the appropriate folds for the other three corners produces the device in the state as illustrated in FIGS. 17 and 17E. Flaps 66 or 56, as the case might be, are then pulled away from each other to cause the end walls 82 and the side walls 98 to the erect position thereof, best seen in FIGS. 18, 18E, 3 and 4.

The folder/portfolio is finally collapsed in a completed folded state by pressing in at arrows 84 and then at arrows 86 to produce the final end result that is the collapsed folder/portfolios as illustrated in the respective groups of FIGS. 19 and 19E or 2, 20 and 20E, or 1, depending upon the choice of preceding previous design steps chosen.

It is particularly important to notice that regardless of the choice of embodiment so constructed that the step which occurs between FIG. 14 and 15, that is the tucking of angular corner 88 under edge 90, as indicated by arrow 92, interlocks the entire device to be 50e, 50f, or 50g and allows fabrication without any adhesive or other fastener devices, staples, etc. The tucked in corner 88 functions as a locking flap, and as shown in FIGS. 3, 4 and 15 all of the locking flaps are concealed from view in the completed portfolio structure.

In operative use the folder/portfolios 50e, 50f and 50g thus created, are extremely useful for storing flat sheet articles 96, papers, pamphlets or other items of a similar nature. Articles 96 thus to be stored, are placed in the folder/portfolios on the bottom surface 94 and then the upstanding end walls 82 and the side walls 98 are collapsed around the papers. The papers placed therein are then captured between the bottom surface and all of the walls as a result a slight force having been applied as indicated by arrows 86, as best seen in FIGS. 18, 18E, 19E and 20E.

Figure 5:
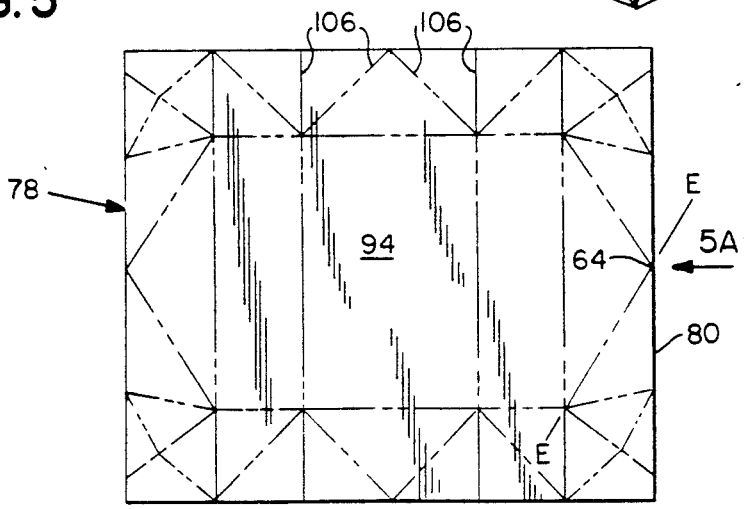
FIG. 5 is a plan view of the unfolded blank paper pattern showing the creases created therein when used to construct the first embodiment illustrated in FIGS. 1 and 20.
Figure 2A:
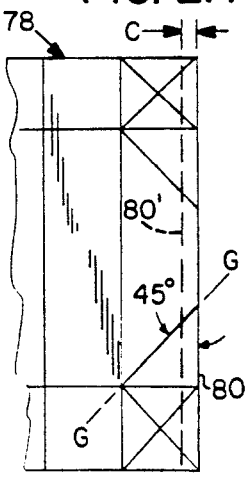
FIG. 2A is a reduced partial plan view with parts broken away similar to FIG. 5 of the unfolded blank paper pattern showing the creases created therein when used to construct the second or third embodiment illustrated in FIG. 2 or FIGS. 6 and 19 respectively.

With reference to FIGS. 3 and 5, it is to be noted that each of the end walls 82 include a set of three triangular formed panels 100, 102 and 104 hingedly secured to each other and to the side walls 98 and the bottom surface 94, and it is the hinging of these panels at fold lines 106 relative to each other which permits the walls to collapse over the article placed therein.

Typical dimensions for example folder/portfolios are listed as follows:

EXAMPLE 1

For storing paper having a dimension of $8\frac{1}{2} \times 11$ the parameters $A=9$ and $B=11\frac{1}{2}$ for the first and third embodiment thus a paper blank having the dimensions of 27 by $20\frac{1}{2}$ would be required.

EXAMPLE 2

For storing paper having a dimension of $8\frac{1}{2} \times 14$ the parameters $A=9$ and $B=14\frac{1}{2}$ for the first and third embodiment, thus a paper blank having the dimensions of 27 by $23\frac{1}{2}$ would be required.

EXAMPLE 3

For storing paper having a dimension of $8\frac{1}{2} \times 11$ the parameters $A=9$, $B=11\frac{1}{2}$ and $C=\frac{1}{2}$ for the second embodiment, thus a paper blank having the dimensions of 26 by $20\frac{1}{2}$ would be required.

It should be noted that although only three embodiments of the folder/portfolios have been pointed out that there are an infinite variety of others that can be fabricated by varying the combinations of the ratios of A, B and C and the way the angle for the E—E or G—G is chosen.

For example a fourth embodiment not illustrated could be constructed as follows:

A fourth embodiment (not illustrated) is almost identical to the first embodiment but is a more general case in that the apex 64 does not lie directly on edge 76 of the folder/portfolio 50e because dimension C is chosen to be a value other than zero, while E is still caused to intersect the edge 80' at the midpoint 64 thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portfolio, for storing flat sheet articles formed from a one-piece sheet material blank to provide a rectangular container comprising:

a) a bottom surface;

b) a pair of end walls hinged at a lower edge to said bottom surface;

c) a pair of side walls hinged at a lower edge to said bottom surface;

d) a pair of handle flaps each hinged at an upper edge thereof to an upper edge of a corresponding one of said side walls;

e) mechanical means for interlocking corner portions of said one-piece sheet material blank so as to maintain a mechanical alignment between said bottom surface, said side walls, said handle flaps and said end walls, said mechanical interlocking means including folded sections of each said corner portions which are frictionally engaged with each other and operatively engaged with folded sections of said handle flaps; and f) means for permitting all of said walls to be simultaneously moved between erect and collapsed positions thereof while said corner portions are interlocked by said mechanical interlocking means;

all of said components a-f being defined in a one-piece sheet material blank.

2. A portfolio as recited in claim 1, wherein said handle flaps are pivotable away from said side walls while said corner portions are interlocked by said interlocking means and said handle flaps are disposed completely outwardly of said side walls and said corner portions when said portfolio is in said collapsed position thereof.

3. A portfolio, as recited in claim 2, wherein said flap is a triangular shape.

4. A portfolio, as recited in claim 2, wherein said flap is a trapezoidal shape.

5. A portfolio according to claim 1, wherein said one-piece sheet material is perfectly rectangular, and said portfolio is formed exclusively from said one-piece sheet material.

6. A portfolio according to claim 5, wherein said rectangular one-piece sheet material blank has a length dimension on a first edge which is three times the length of a short edge of the bottom surface of said portfolio as ultimately fabricated and has a second length dimension on a second edge, perpendicular to the first edge, which is the sum of two perpendicular edges of said bottom surface.

7. A portfolio according to claim 5, wherein said portfolio is formed exclusively from said one-piece sheet material blank, and said blank has no discontinuities defined therein.

8. A portfolio according to claim 1, wherein said means for permitting simultaneous movement of all of said walls permits said portfolio to move from said erect position to said collapsed position when a slight force is applied to said side walls, and said portfolio being adapted to remain in said collapsed position completely enclosing any papers flat sheet articles stored therein.

9. A portfolio according to claim 1, wherein said folded sections of said corner portions comprise locking flaps formed in said corner portions and which are tucked into engagement with adjacent sections of said corner portions such that the locking flaps are at least partially hidden from view behind said adjacent sections in the portfolio.

10. A portfolio according to claim 1, wherein said handle flaps are hingedly connected to said side walls fully along said upper edges of said side walls, respectively.

11. A method for fabricating a portfolio exclusively from a single rectangular blank of sheet material, for storing flat sheet articles, which comprises:

a) choosing a perfectly rectangular one-piece sheet material blank;

b) folding said one-piece sheet material blank so as to form two side walls, two end walls, two handle flaps and a bottom surface, said side and end walls being hingedly connected at lower edges thereof to respective edges of said bottom surface, and each of said handle flaps being hingedly connected to an upper edge of a corresponding one of said side walls;

d) folding all corner portions of said one-piece sheet material blank in an interlocking relationship with adjacent portions of said blank so as to maintain a mechanical alignment between said bottom surface, said handle flaps, said side walls and said end walls; and e) forming hinge lines on at least two of said side walls and said end walls such that all of such walls may be simultaneously moved between erect and collapsed positions thereof while said corner portions are in said interlocking relationship.

12. A method for fabricating a portfolio as recited in claim 11, wherein said handle flaps are pivotable away from said said side walls while said corner portions are in said interlocking relationship, and said handle flaps are disposed completely outwardly of said said side walls and said corner portions when said portfolio is in said collapsed position.

13. A method for fabricating a portfolio as recited in claim 12, wherein said handle handle flaps are folded to have a triangular shape.

14. A method for fabricating a portfolio as recited in claim 12, wherein said handle flaps are folded to have a trapezoidal shape.

15. A method according to claim 11, wherein said rectangular one-piece sheet material blank is chosen to have a length dimension on a first edge which is three times the length of a short edge of a bottom surface of said portfolio as ultimately fabricated, and has a length dimension on a second edge perpendicular to said first edge, which is the sum of two perpendicular edges of said bottom surface.

16. A method according to claim 11, wherein said blank has no discontinuities defined therein.

17. A method according to claim 11, wherein sections of each said corner portions are further folded to define locking flaps therein, and said step of folding all of said corner portions in an interlocking relationship involves tucking said locking flaps under adjacent sections of said corner portions such that said locking flaps are at least partially hidden from view behind the adjacent sections in the fabricated portfolio.

18. A method according to claim 11, wherein said handle flaps are folded relative to said side walls such that said handle flaps extend fully along said upper edges of said side walls.

19. A portfolio for containing flat articles therein, comprising:

a flat bottom surface having a plurality of edges;

a plurality of wall members hingedly connected, respectively, to said edges of said bottom surface, said wall members being selectively pivotable between erect and collapsed positions thereof;

a pair of handle flaps hingedly attached to upper edges of two of said wall members, respectively;

means for interlocking said wall members and said handle flaps together in a predetermined cooperative alignment;

means for permitting said wall members to be simultaneously moved between said erect and collapsed positions thereof while said wall members and said handle flaps are interlocked together by said interlocking means;

said bottom surface, said wall members, said handle flaps, said interlocking means and said means for permitting simultaneous movement all being formed exclusively from a single blank of sheet material having a perfectly rectangular shape; and said interlocking means including corner portions of said rectangular blank of sheet material which have been folded such that sections of the corner portions are frictionally engaged with each other and operatively engaged with folded sections of said handle flaps.

20. A portfolio according to claim 19, wherein said handle flaps are pivotally connected to said two of the wall members such that the handle flaps are pivotable away from said two of the wall members while said wall members and said handle flaps are interlocked together by said interlocking means, said handle flaps are connected to said two of the wall members fully along upper edges of said two of the wall members, said handle flaps are disposed completely outwardly of said two wall members and said corner portions when the portfolio is in the collapsed position thereof, and said sheet material blank has no discontinuities defined therein.

* * * * *